United States Patent [19]

Meroth

[11] Patent Number: 4,722,171

[45] Date of Patent: Feb. 2, 1988

[54] BITLESS BRIDLE FOR SADDLE AND DRAFT ANIMALS

[76] Inventor: Erwin Meroth, Maternusstrasse 3, D-5000 Koln 50, Fed. Rep. of Germany

[21] Appl. No.: 857,141

[22] Filed: Apr. 29, 1986

[51] Int. Cl.[4] ..... B68B 1/04

[52] U.S. Cl. ..... 54/6 R

[58] Field of Search ..... 54/6 R, 6 A, 16, 24, 54/36

[56] References Cited

U.S. PATENT DOCUMENTS

| | | | |
|---|---|---|---|
| 79,628 | 7/1868 | Bauerschmitt | 54/6 R |
| 184,296 | 11/1876 | Poorman | 54/36 X |
| 750,200 | 1/1904 | Kindig, Jr. | 54/6 R |
| 2,669,816 | 2/1954 | Pletsch | 54/6 R |

*Primary Examiner*—Robert P. Swiatek

*Attorney, Agent, or Firm*—K. S. Cornaby

[57] ABSTRACT

A bitless bridle has a noseband (2) which on each side ends with a lateral ring (24), and has a flexible and elastic metal strip (28) embedded in the noseband. The bridle also has a left and a right, short guide piece (34) on each side connected to lateral rings (24) from which guide pieces hang downwardly and end with a guide ring (40). A left and a right rein (46, 48) are fastened to the lateral rings (24); and the reins run under the chin of the animal where they cross. The right rein is connected to the left lateral ring and the left rein is connected to the right lateral ring. The reins run through the guide rings (40) on their respective sides (FIG. 1).

8 Claims, 4 Drawing Figures

BITLESS BRIDLE FOR SADDLE AND DRAFT ANIMALS

BACKGROUND OF THE INVENTION

This invention relates to a bridle without a bit for saddle and draft animals and is intended especially for horses.

Bridles, also called halters or head harnesses, are devices placed on the heads of saddle and draft animals, usually horses, which are used to guide and lead the horse. They customarily are made of a framework of leather straps to fit on the horse's head, the so-called head harness, to which the reins or lines from the hands of the rider or driver are attached. The head harness consists of a browband running across the brow and a crown piece, which runs down behind the ears and in certain cases is provided with a throat latch. Usually a head harness of this type has a bit (a snaffle bit or curb bit), but there are also bridles without bits, so-called stable halters, which a horse wears while at rest. Stable halters of this type are not used to direct or guide a horse.

Several problems can occur with a bridle having a bit. It is often difficult for a young horse to get used to a bit, and many horses are never completely able to stand a bit for long, so that some horses accept a bit with distaste or against their will. Furthermore, injuries in those areas tended by the bit, e.g. the lips, can occur so that riding with a bit is not possible until the injuries are healed. Finally, bridles with bits are from the standpoint of pure weight very heavy. They are usually adjusted only for a special purpose and are not well suited for exercising on a long rope. They are also not a good solution from a medical standpoint.

Starting with these facts in mind, the invention has the objectives of avoiding the disadvantage of bridles with bits and of creating a bridle without a bit which is light in weight, can be produced easily and assures the positive guiding and control of horses in many kinds of activities, for example, jumping, training, shoeing, exercising on a long rope, etc. and is not harmful from a practical and medical standpoint, and is accepted by horses, usually without problems.

SUMMARY OF THE INVENTION

The objections are met by a bridle of the invention having no bit, which has the following characteristics: a noseband which ends on both sides of the head in respective lateral rings. Embedded in the noseband is a pliable and elastic metal strip, for example a strip of steel. There are respective left and right lateral short guide pieces attached to each lateral ring, hanging down to about the height of the lower jaw of the horse and ending in a guide ring. The left and right reins are attached to the respective lateral rings, with the left rein attached to the right lateral ring and the right rein to the left lateral ring. The reins run under the animal's chin where they cross and then go through the guide rings on the opposite sides.

In contrast to prior art bridles, the reins are not attached to the side of the head on which they are located, but to the lateral ring on the opposite side of the head, and they cross each other under the horse's chin in an "X". This arrangement creates a noose (or a curb strap or hackamore), the parts of the noose being the noseband and the two rein straps. If both reins are pulled at the same time, the noose is tightened and a tight loop is formed around the horse's head. If only one rein is picked up and pulled, then the horse's head is pulled in the appropriate direction even though the rein strap is attached to the opposite side of the horse's head.

The guide rings serve the purpose of guiding the reins. The passage of the reins through the guide rings ensure that the "X"-shaped crossover of the reins remains under the horse's lower jaw.

The noseband can also be adjusted and fitted to the individual shape of the nose of the horse or of another animal because of the embedded metal strip. In spite of its pliable nature, the noseband is nevertheless elastic and because of this, it exerts a restorative force on the reins, and after being tightened, the noose opens up and loosens automatically when the reins are released. The noseband is in general U-shaped, but its two sides can extend outwardly, and exert a pull on the reins.

The bitless bridle of the invention has many advantages:

It can be used in many different situations; for example, for showing off a horse, for exercising at the end of a long rope, for training, for jumping, for shoeing, for taking a horse to the veterinarian, etc. When exercising or exhibiting, etc., both reins are not attached to the sides up under the ears as in the case of the usual bridle, but are seen hanging under the chin as they come from the guide rings. The ends of reins are joined together under the chin, and if one pulls on the joined ends, the described noose is tightened and the horse is controlled clearly and definitely. When exercising at the end of a long rope, it is advantageous that the pull on the two joined reins always comes from the outside. The horse is always pulled towards the inside and thus the force does not work to the disadvantage of the horse, which can be led gently but definitely.

The bridle as described avoids injuries, pressure points and chafe marks. It is especially suited for horses whose mouths have been injured. Because the horse can continue to be ridden or used without interfering with the healing process.

The bridle, because of the noose-shaped enclosure around the horse's head, has a good hold. It doesn't slip, resulting in a compact, positive action. There is no possibility of a bit being pulled out of the mouth. If the horse panics, there is the possibility of controlling the horse with both reins. Through the noose-effect, the mouth of the horse remains closed. If this is not enough to quiet the horse and the horse must be allowed to run loose, at the end of the period of panic the horse can be more easily caught because the reins hang down and are not up high as with the usual bridles.

The bitless bridle as described can be used together with a bridle with bit as, for example, when breaking a young horse that is to be trained to use a bit. In this case the bridle with bit is adjusted so that it is very loose and at first is not used at all. The horse is then at first controlled, ridden and led by the bridle without bit. Later, when the horse has grown used to the bit, the bridle without bit can be removed. Thus, every day the bridle with bit can be tightened, and snaffle reins, in case they are present, can be pulled more and more each day so that the head comes down lower. This can be done without tormenting or causing complications for the horse. Control of the horse is gentle but definite.

When riding normally, the pull on one rein creates a half noose. If, for example, the left rein is pulled, then the noseband and the guide piece on the right side of the horse's head are pulled to the left and slightly upward so that the desired directional control comes about.

The bridle as described is ultimately very suitable for difficult horses, as for example with Arabian horses. With the help of this bridle it can be discovered why a horse is difficult, as, for instance, in the case of one that rears up or bolts. In this case the bitless bridle is used together with the normal bridle. Only one set of reins is then used at a time. From the reactions of the horse, one can discover whether or not there are problems with mouth, tongue, teeth or jaw.

The bridle as described finally can be used for a single horse in harness, in particular for sulkies.

In a preferential further development of the invention, a strip of soft material is placed under the noseband, in particular a strip of foam plastic which is water resistant and has closed pores. By means of the soft material, the sensitive ridge of the nose is protected and pressure and chafe marks under the noseband are avoided.

The lateral rings are made relatively large so that at least three straps (the noseband, the guide piece, and the cheek piece) can be attached thereto, and there can still be sufficient freedom of movement for the noose to form and the bridle to function properly. The lateral rings are round.

In contrast to the lateral rings, the guide rings have a smaller diameter, which is about 1.5 times the width of the reins. The guide rings are also round.

In a preferential further development, a head harness is attached to the lateral rings with at least a throat latch, but preferably also with browband and crown piece. With the crown piece, etc. better hold of the bridle is assured.

Finally, it is advantageous that each of the lateral rings be larger in diameter than the guide rings and that the diameter of the guide rings be determined by the width of the reins. Each lateral ring is so large that it can accommodate four straps. Thereby, in a preferential further development of the invention, the two straps of the guide pieces or the reins in the area below the lateral rings are so arranged that the reins can be brought closer to the horse's mouth and the guide pieces can be brought nearer to the horse's ears.

Further advantages and characteristics of the invention are derived from the following description of the preferred embodiment of the invention.

THE DRAWING

A preferred embodiment of the invention is illustrated in the attached drawing in which:

FIG. 1 is a perspective view of the left side of a horse's head on which is placed a bitless bridle;

FIG. 2, a bottom plan view of the horse's head as seen from the direction of arrow II in FIG. 1;

FIG. 3, a sectional plan view along line III—III in FIG. 1; and

FIG. 4, a sectional view along line IV—IV in FIG. 3 through the noseband.

DETAILED DESCRIPTION OF THE ILLUSTRATED EMBODIMENT

Figure 1:
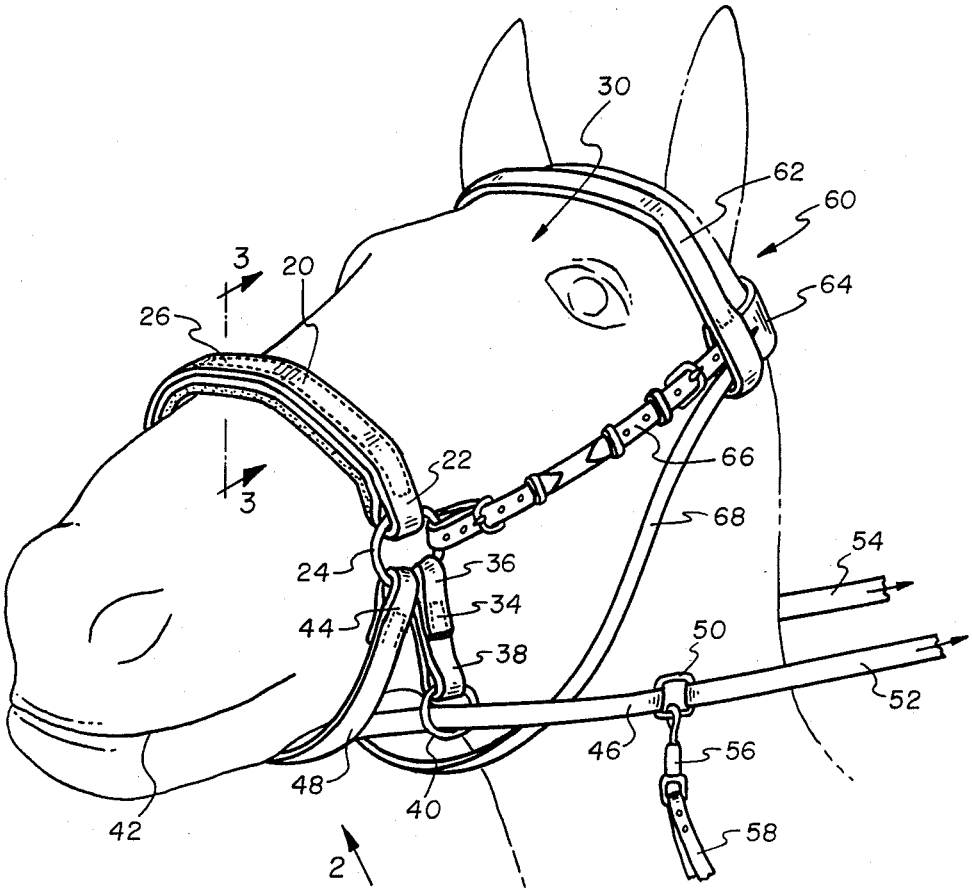

The bitless bridle illustrated in the drawing has a noseband 20, which is about 30 cm long, and which essentially is made of leather straps about 2 cm wide and twice as long as the noseband. These leather straps are folded over and laid double so that loops 22 are formed at both ends around each lateral ring 24.

In FIG. 1, the left lateral ring 24 is shown. Each ring has a free inner diameter of about 4 cm and is made of 5 mm round material. The ring 24 can be freed from loop 22 only by the destruction of loop 22 or the destruction of the lateral ring 24 itself. The ring is made of metal and is preferably chrome-plated. Between the loops 22, the double straps (see FIG. 3) of the noseband 20 are sewed together along each side. FIG. 1 shows the threads 26.

Figure 3:
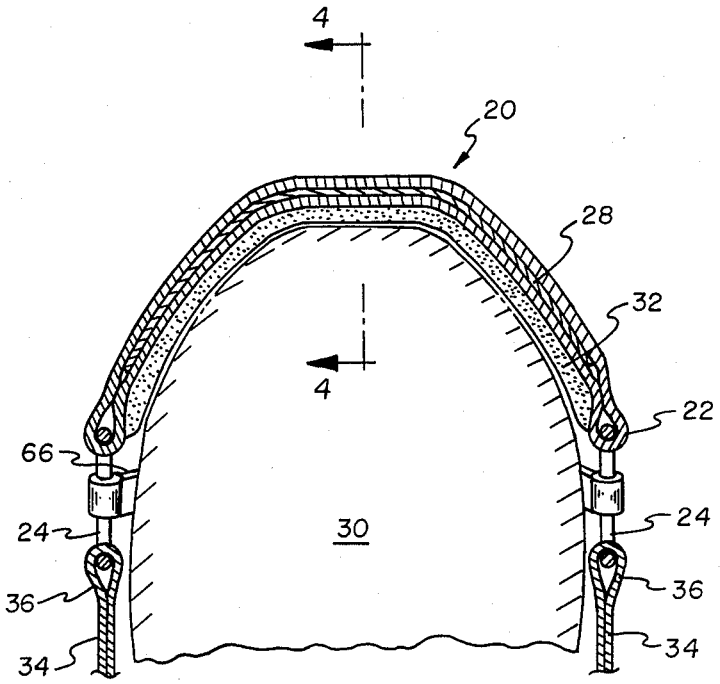
Figure 4:
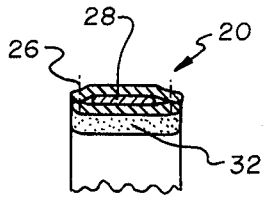

Between the double straps there is a steel strip 28 which is also glued on both sides to the leather straps. For this an epoxy adhesive is used. The steel strip 28 is about 5 mm wide, 1.5 mm thick and has a total length of about 22 cm. The steel is hard, white polished spring steel with a rigidity of 160 to 180 kg/mm$^2$. It can be bent but is nevertheless elastic. The illustrations in FIGS. 1 and 3 show that the noseband 20 is bent approximately U-shaped, and because of the steel strip 28 within it it remains the shape shown in FIG. 3.

The noseband 20 on its underside next to the horse's head 30 is covered with a strip of soft material. In the illustrated example, a foam plastic strip 32 made of a soft, water-resistant material with closed pores is used. It is glued to the underside of the noseband 20 and becomes a part of the latter. It extends out into the area of the loops 22 so that the lateral rings 24 have a definite space between them and the head of the horse. It protects the sensitive nasal area of the horse from pressure and chafing.

From each lateral ring 24, a short guide piece 34 hangs down. In FIG. 1, the left guide piece 34 is shown. It is about 5 cm long and is also made of one piece of leather strap about 2.5 times the length of the guide piece 34 with the same thickness as the straps in the noseband 20. By folding the strap double, an upper loop 36 around the lateral ring 24 and the lower loop 38 around the guide ring 40 are created. The guide ring 40 is smaller than the lateral ring 24. It has an internal diameter of 3 cm and a material thickness of 2.5 mm. Likewise, on the lower part of each lateral ring 24, at the side of loop 36 of the guide piece 34 towards the horse's mouth 42, there is a loop 44 of the reins 46, 48 around the lateral ring 24. In FIG. 1, it is the right rein 48 which is attached by loop 44 around the left lateral ring 24 in front of the left guide piece 34. The left rein 46 is also visible and runs through the left guide ring 40 of the left guide piece 34.

Both rein straps 46, 48 are the same length, about 40 cm. They end at ring 50 where they are attached to the actual reins 52, 54. For exercising on a long rope, these reins 52, 54 are not necessary. The two rings 50 of the rein straps 46, 48 are then joined under the chin of the horse. For this purpose, a snap 56 on a swivel is used and is connected to a strap 58.

Figure 2:
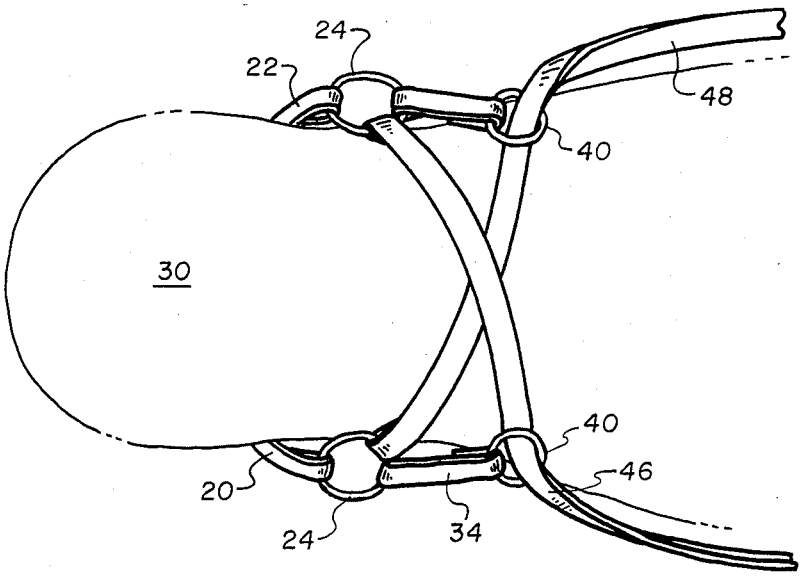

Rein straps 46, 48 have the same thickness as the other leather straps, but as can be seen in FIG. 1, they are single straps and only at loops 44 is the material doubled. The rein straps cross over each other in an "X" under the chin of the horse as can be seen in FIG. 2. This illustration shows also that the guide rings 40 serve primarily to form and keep intact the noose, which is made up of the noseband 20 and the reins 46, 48. They also serve to keep the reins 46, 48 away from under the mouth. The bridle shown in FIG. 1 also has a head halter 60 which consists of a browband 62 across the horse's brow, a crown piece 64, cheek pieces 66, and a throat latch 68. These parts are obvious, but it should be noticed that the cheek pieces 66 are fastened to the lateral rings 24. Thus, in FIG. 1, it can be seen that the left lateral ring 24 has the following arrangement: Above, at 12 o'clock, is the loop 22 of the noseband 20. To the right, at about 3 o'clock, is the loop of the cheek piece 66, which can be adjusted in length. Below, at 5 or 6 o'clock, is the loop of the guide piece 34, and immediately next, at about 6 or 7 o'clock, is the loop of the right rein strap 48. The last two loops are immediately next to each other, but the other loops have ample space between them around the lateral ring 24, so that they can move freely around the circular lateral ring 24 without being stuck in any one position. Because of this the bridle can adapt to the movements of the horse's head.

The same is also true for the guide rings 40. Their smaller diameter is about 1.5 times the width of the reins 46, 48, so that the rein can move freely inside the guide ring 40. On the other hand, it is advantageous to select rings 50 on the reins 46, 48 such that they are so large that they can barely go through the guide rings 40 or cannot go through at all. This way the reins 46, 48 are prevented from slipping out of the guide rings 40.

Although, as is customary, all straps, especially 20, 34, 46, and 48, were all made of leather, it is basically possible to use other non-stretchable, flexible strap-like materials. Rings 24, 40 are round and smooth so that the loops attached to them can slide freely and that the reins 46, 48 can turn and move freely through the guide rings 40.

I claim:

1. A bitless bridle, characterized by:

a noseband (20) ending on each side with a lateral ring (24), a flexible and elastic metal strip (28) being embedded in the noseband;

left and right short guide pieces (34) being attached to the lateral rings, and hanging downwardly therefrom and each ending with a guide ring (40); and left and right reins (46, 48) being attached to the lateral rings (24), and running under the chin of the animal and through the guide rings (40); the right rein being attached to the left lateral ring and the right rein being attached to the left lateral ring, with both reins crossing over each other under the chin of the animal.

2. A bridle according to claim 1, characterized by the noseband being constructed of a leather strap about twice the length of the noseband (20); the strap being folded double and having a metal strip (28) between the layers.

3. A bridle according to claim 1, characterized by the steel strip (28) being glued to the leather straps of the noseband (20) on both sides.

4. A bridle according to claim 1, characterized by the lower side of the noseband (20) being covered with a layer of soft material (32), which is non-absorbent and extends over the length and breadth of the noseband (20).

5. A bridle according to claim 1, characterized by the rings (24, 40) being round and having a smooth surface; with the lateral ring (24) being so large that it can accommodate at least four loops and still permit space between the loops; each guide ring (40) having a smaller diameter than the lateral ring but being larger than the width of the reins (46, 48), and preferably having a diameter 1.5 times the width of the rein (46, 48).

6. A bridle according to claim 1 characterized by a loop (44) of each rein (46, 48) and each guide piece (34) lying next to each other on the lateral ring (24), the loop (44) of the rein strap (46, 48) lying in front of the loop (36) of the guide piece (34).

7. A bridle according to claim 1 characterized by the reins (46, 48) ending in rings (50) which have an external diameter equal to or larger than the inner diameter of the guide rings (40).

8. A bridle according to claim 1, characterized by a head harness (60) with a crown piece (64) and cheek pieces (66) being connected by a loop to the lateral rings (24).

* * * * *